US012371870B2

(12) United States Patent
Cseri

(10) Patent No.: US 12,371,870 B2
(45) Date of Patent: Jul. 29, 2025

(54) QUICK-CHANGE DEVICE HAVING A CONTROL DEVICE WITH A MECHANICALLY AND HYDRAULICALLY CONTROLLABLE VALVE

(71) Applicant: Béla Cseri Besitzunternehmung GbR, Nohra (DE)

(72) Inventor: Béla Cseri, Langenau (DE)

(73) Assignee: Béla Cseri Besitzunternehmung GbR, Nohra (DE)

( * ) Notice: Subject to any disclaimer, the term of this patent is extended or adjusted under 35 U.S.C. 154(b) by 352 days.

(21) Appl. No.: 18/248,751

(22) PCT Filed: Aug. 19, 2021

(86) PCT No.: PCT/DE2021/100702
§ 371 (c)(1),
(2) Date: Apr. 12, 2023

(87) PCT Pub. No.: WO2022/083816
PCT Pub. Date: Apr. 28, 2022

(65) Prior Publication Data

US 2023/0417011 A1 Dec. 28, 2023

(30) Foreign Application Priority Data

Oct. 19, 2020 (DE) ..... 10 2020 127 479.3

(51) Int. Cl.
*E02F 3/36* (2006.01)
*E02F 9/22* (2006.01)

(52) U.S. Cl.
CPC ..... *E02F 3/3663* (2013.01); *E02F 3/3622* (2013.01); *E02F 3/3627* (2013.01);
(Continued)

(58) Field of Classification Search
CPC ..... E02F 3/3622; E02F 3/3627; E02F 3/3663; E02F 9/2225; E02F 9/2267; E02F 9/2285
(Continued)

(56) References Cited

U.S. PATENT DOCUMENTS

2006/0237201 A1 10/2006 Moriuchi
2014/0356059 A1* 12/2014 Friedrich ..... E02F 3/3618 403/316

(Continued)

FOREIGN PATENT DOCUMENTS

DE 20 2014 004 430 U1 10/2014
DE 10 2013 110 420 A1 4/2015
WO WO 2019/032000 A1 2/2019

*Primary Examiner* — Saul Rodriguez
*Assistant Examiner* — Brendan P Tighe
(74) *Attorney, Agent, or Firm* — Christensen, Fonder, Dardi & Herbert PLLC; John P. Fonder

(57) ABSTRACT

A quick-change device for coupling an attachment unit to a work machine, having a securing element, which is pushed into a locking position and an unlocking position to lock or secure and unlock or release, respectively, the coupled attachment unit. To displace the securing element, a control device is present, which has a switch valve, which can be actuated hydraulically and mechanically via a button, and is designed such that the attachment unit can be locked or secured only when the button is engaged but can be unlocked or released independently of the position of the button.

5 Claims, 6 Drawing Sheets

(52) U.S. Cl.
CPC ..... *E02F 9/2225* (2013.01); *E02F 9/2267* (2013.01); *E02F 9/2285* (2013.01)

(58) Field of Classification Search
USPC ..... 414/723
See application file for complete search history.

(56) References Cited

U.S. PATENT DOCUMENTS

| | | | | |
|---|---|---|---|---|
| 2017/0037882 | A1* | 2/2017 | Veit | E02F 9/2296 |
| 2017/0227027 | A1* | 8/2017 | Bauer | E02F 3/3654 |
| 2022/0034436 | A1* | 2/2022 | Holst | F16L 37/56 |

* cited by examiner

QUICK-CHANGE DEVICE HAVING A CONTROL DEVICE WITH A MECHANICALLY AND HYDRAULICALLY CONTROLLABLE VALVE

PRIORITY CLAIM

The present application is a National Phase entry of PCT Application No. PCT/DE2021/100702, filed Aug. 19, 2021, which claims priority from German Patent Application No. 10 2020 127 479.3, filed Oct. 19, 2020, the disclosures of which are hereby incorporated by reference herein in their entirety.

FIELD OF THE INVENTION

The invention relates to a quick-change device for a work machine, for coupling an attachment unit, of the type generically known from DE 20 2014 004 430 U1.

BACKGROUND OF THE INVENTION

Quick-change devices on work machines are used for quick coupling of different types of attachment units. Work machines include, for example, excavators, wheel loaders, and machines from the construction and agricultural sectors. Attachment units include buckets, hammers, tillers, grapples, shovels and the like.

The use of quick-change devices enables a machine operator to quickly couple various attachment units to the work machine and then work with them. Typical quick-change devices are connected to an attachment unit via two connections. The connections are formed in each case via a connection partner present on the quick-change device and a connection partner present on the attachment unit, with the connection partners assuming a relative spatial position to one another in coupling mode and maintaining said position in working mode. It is mandatory to secure this relative spatial position (working position) to each other, if the connection for the working mode still has impermissible degrees of freedom, and it advantageously increases safety.

A first connection is usually formed by a pair of claws formed on the quick-change device and a locating pin formed on the attachment unit. In this case, the pair of claws encloses the locating pin except for a claw opening larger than the diameter of the locating pin, thus forming a directly form-fitting first connection which, apart from the possibility of the locating pin slipping out of the claw opening, leaves the locating pin only one degree of freedom, namely rotation about its geometric axis. Such a first connection is almost universally found in the prior art concerning quick-change devices. Some of these quick-change devices have securing elements which, after making this first connection, or both connections, secure the working position of the two connecting partners, i.e. the position of the locating pin within the pair of claws, by restricting a free opening formed by the claw opening by pushing or pivoting the securing element in so that it becomes smaller than the diameter of the locating pin.

After this first connection has been made, the attachment is positioned on the quick-change device by a pivoting movement of the quick-change device about the geometric axis of the first locating pin in such a way that the attachment and the quick-change device assume a relative spatial position to one another in which the second connection is created.

In a large number of the known quick-change devices, the second connection is made via a locating plate present on the quick-change device and a locking plate present on the attachment, which are joined together in the coupling mode. To secure the working position of these connecting partners, two locking pins are inserted through the locating plate into openings provided for this purpose in the locking plate.

Locking is controlled in such a way that the locking pins can only be pushed into the locking plate after the attachment has been swiveled completely and correctly onto the quick-change device. This means that a locking position can only be established when the two connection partners have assumed the intended relative spatial position (working position) to each other for locking the second connection.

Since the attachment is located below the quick-change device during a work process, the force flow within the first connection is basically via the first pair of claws, and the force flow within the second connection is via the at least one locking element. This means that after the first locating pin has been hooked into the first pair of claws, the working machine is not ready for operation until the second connection, in which the locking element is in the locking position, is also fully established.

A number of different quick-change devices are known which, based on the principle described above, are designed differently, e.g. to ensure secure locking of the second connection and/or securing of the first connection, by bringing a securing element or locking pin (hereinafter only referred to as a securing element) into a locking position.

Some of these quick-change devices have a mechanical button which is actuated by a connecting partner of the attachment unit when coupling the attachment unit. In this case, the button is in a position disengaged from the quick-change device when the relevant connecting partner has not yet assumed the intended spatial position (working position) with respect to the connecting partner of the quick-change device, and is in a fully engaged position when the relevant connecting partners are connected to each other. The button and an associated hydraulic control device control the movement of the locking element between an unlocking position and the locking position. In the unlocking position, the relevant connection can be released simply by moving the quick-change device relative to the attachment unit. In the locking position, the relevant connection cannot be released.

A control device for controlling a double-acting hydraulic cylinder and thus the movement of a locking element, between an unlocking position and a locking position, is known from DE 10 2013 110 420 A1. An unlocking chamber and a locking chamber of the hydraulic cylinder are alternatively connected to a pressure medium connection or a tank via a switch valve. The switch valve is moved into a first switching position by a compression spring and into a second switching position by a hydraulic control pressure against the force of the compression spring. The hydraulic control pressure is applied when pressure acts on the line connecting the pressure medium connection to the unlocking chamber and a button has been moved to a fully engaged position, which is only the case when an attachment has been properly coupled, i.e. in this case when a coupling element has been inserted into the mount. This allows the coupling element to be secured automatically after it has been moved into the mount without activating the hydraulic cylinder and thus without changing the pressure applied. A valve arrangement is integrated in the control line of the switch valve, which opens or interrupts the control line for a pressure medium flow influenced by the mechanical actuation of the button.

The aforementioned DE 20 2014 004 430 U1 discloses a quick-change device, which is referred to as a quick coupler therein, with two connections in the sense of the general description given above. The two connections are formed there by a coupling mount and a locking mount, respectively, and one locking axle each. The locking axle, properly arranged in the locking mount, is locked by a locking element to be actuated by a pressure medium. A double-acting hydraulic cylinder is provided to actuate the locking element. A securing element to be actuated by a pressure medium is assigned to the coupling mount and is actuated via two single-acting hydraulic cylinders (locking cylinder and unlocking cylinder) connected to the same pressure medium circuit as the locking element. A locking pressure line of the double-acting hydraulic cylinder for moving the locking element is connected via a switch valve to either the locking cylinder or the unlocking cylinder of the securing element. When the locking pressure line of the double-acting hydraulic cylinder is connected to the locking cylinder, the locking element and the securing element are locked or unlocked simultaneously. The switch valve is either hydraulically controlled when there is pressure in the locking pressure line of the double-acting hydraulic cylinder, or mechanically controlled by a spring-loaded button. When an attachment unit is uncoupled, the button moves to a disengaged, "motion-transmitting" position, but the switch valve is not yet switched, so that pressure continues to be applied to the unlocking pressure line of the double-acting hydraulic cylinder and to the unlocking cylinder. When a new attachment unit is coupled, the button is moved to an engaged position and switches the switch valve, whereby the still pressurized unlocking pressure line of the double-acting hydraulic cylinder is now connected to the locking cylinder and the securing element is locked independently of the locking element. In the engaged position, the button returns to a release position, i.e. the switch valve can now be switched hydraulically again when pressure is again applied to the locking pressure line of the double-acting hydraulic cylinder. In this case, the pressure remains applied to the locking cylinder.

The special feature of the hydraulic circuit of the aforementioned DE 20 2014 004 430 U1 is that a coupled attachment can be secured via the mechanical actuation of a button, i.e. the securing element locks one of the two connections, independently of locking the other connection, by means of a locking element. To lock the securing element when the locking element is still unlocked, the button is pushed by the attachment into an engaged position, switching a switch valve. Here, the switch valve is switched mechanically into one of two switching positions and hydraulically into the other switching position.

SUMMARY OF THE INVENTION

It is the object of the invention to provide a quick-change device with a control device, with which the unlocking of a securing element can alternatively take place hydraulically or mechanically.

The object is achieved by a quick-change device for coupling an attachment unit to a work machine, having a securing element which is pushed into a locking or unlocking position to lock or secure and unlock or release, respectively, the coupled attachment unit, and having a control device. The control device has a hydraulic cylinder, with an unlocking chamber and a locking chamber, and a changeover valve. The changeover valve is a two-way valve with four connections, with a first consumer connection, a second consumer connection, a pressure medium connection and a tank connection. A first line connects the first consumer connection and the unlocking chamber.

A switch valve is arranged between the second consumer connection and the locking chamber; the switch valve can be controlled hydraulically via a hydraulic control connection and mechanically via a spring-loaded button.

The switch valve can be switched between an open position and a closed position and can be switched to the open position when the button is fully engaged, so that the securing element, controlled via the changeover valve, is pushed into the locking or unlocking position. The hydraulic control connection is connected to the first line, whereby the switch valve is switched to the open position by applying hydraulic pressure from the first line even when the button is disengaged or not fully engaged, which pushes the securing element to the unlocking position regardless of the position of the button.

Advantageously, the switch valve has a valve return spring with a spring force that switches the switch valve to the closed position when no hydraulic and/or mechanical pressure is applied.

In a particularly advantageous embodiment, the button is assigned a button return spring connected in series with the valve return spring.

It is also advantageous to arrange a pilot-operated check valve upstream of the locking chamber, with a hydraulic unlocking connection connected to the first line.

Advantageously, the switch valve and the check valve are integral components of a switch valve unit.

BRIEF DESCRIPTION OF THE DRAWINGS

The invention will be explained in more detail below with reference to exemplary embodiments and drawings. In the drawings.

DETAILED DESCRIPTION OF THE DRAWINGS

A quick-change device 10 according to the invention differs from prior art quick-change devices by a different control device, and will be explained below on the basis of various possible switching modes of a hydraulic circuit, shown in FIGS. 3*a*-3*d*.

Figure 1:
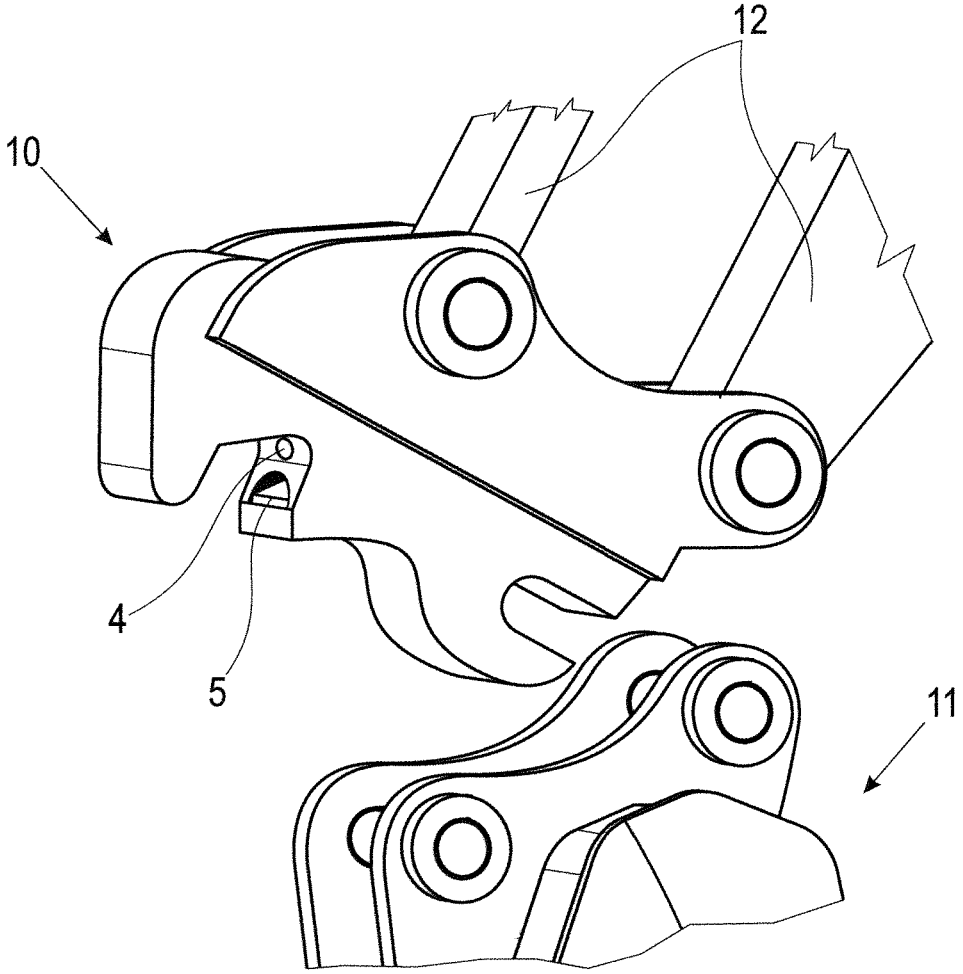
FIG. 1 shows a first embodiment of a quick-change device.
Figure 2:
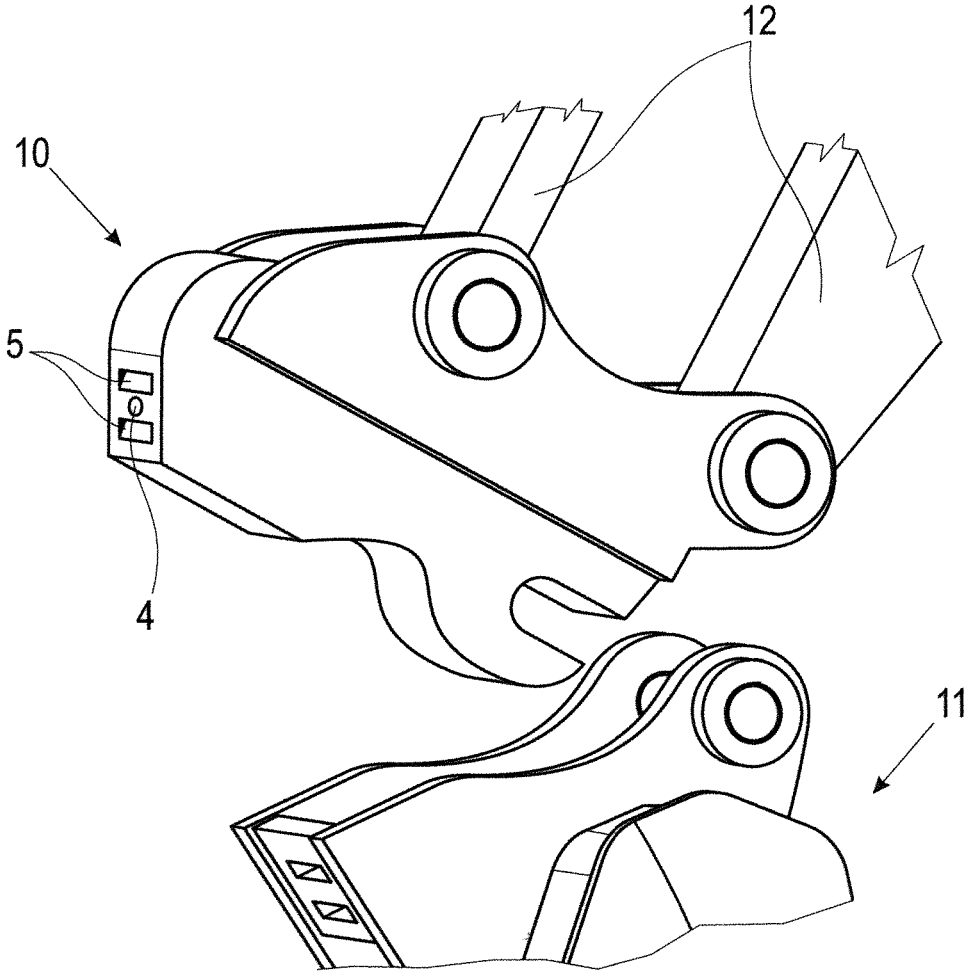
FIG. 2 shows a second embodiment of a quick-change device.

FIG. 1 and FIG. 2 show schematic diagrams of two known embodiments of quick-change devices 10 attached to a work machine 12, due to the different design of the connecting partners on an attachment unit 11. A securing element 5 and a button 4 are associated with one of the two connections formed when the attachment unit 11 is coupled.

FIGS. 3*a*-3*d* schematically show the quick-change device 10 with the securing element 5 and the control device in the form of a hydraulic circuit.

The hydraulic circuit substantially contains a changeover valve 3, a switch valve unit 2 with a non-return function, which can be switched mechanically via a spring-loaded button 4 and, in addition, hydraulically against a spring force, and a hydraulic cylinder 1 with an unlocking chamber 1.1, a locking chamber 1.2 and a piston 1.3, to which the securing element 5 is attached indirectly or directly.

The control device is provided for pushing the securing element 5 alternatively into a locking position and an unlocking position.

It is configured so that the securing element 5 can only be moved into the locking position when the button 4 is fully in an engaged position. It is essential to the invention that the securing element 5 can be moved into the unlocking position at any time, regardless of the position of the button 4.

This can solve a problem arising from an unavoidable leak in the hydraulic control system of a work machine 12. During a prolonged shutdown of the work machine 12, the pressure in the unlocking chamber 1.1 slowly decreases. The pressure force in the unlocking cylinder 1.1 is reduced and the securing element 5 may be unintentionally pushed in the direction of the locking position. If an attachment unit is then to be coupled, it may not be possible to actuate the button 4, which is fully in a disengaged position due to the spring force of the button return spring 4.1, or at least it may not be possible to fully engage it, since it projects beyond the securing element 5 in the direction of the attachment unit to be coupled and thus blocks the path for mechanical actuation of the button 4 by the attachment unit 11.

The alternative pressurization of the unlocking chamber 1.1 or the locking chamber 1.2, by supplying a pressurized fluid, moves the securing element 5 linearly into the unlocking position or the locking position, respectively.

The changeover valve 3 is a 2/4-way valve with two switching positions and four connections, namely a first consumer connection A, a second consumer connection B, a pressure medium connection P and a tank connection T. The pressure medium connection P is connected to a hydraulic pump, which pumps a fluid under pressure into the hydraulic circuit to alternatively apply hydraulic pressure to the unlocking chamber 1.1 or the locking chamber 1.2. If the hydraulic pump is switched off, the hydraulic connection between the pressure medium connection P and the hydraulic cylinder 1 is closed and the pressure present remains stable, at least for a period relevant to the working time of a work machine.

The tank connection T is connected to a tank.

In a first switching position of the changeover valve 3, the first consumer connection A is connected to the pressure medium connection P, and in a second switching position, the second consumer connection B is connected to the pressure medium connection P.

A first line V1 connects the first consumer connection A of the changeover valve 3 to the unlocking chamber 1.1 and to an opening and unlocking connection 2.4 of the switch valve unit 2.

A second line V2, the switch valve unit 2 and a third line V3 connect the second consumer connection B to the locking chamber 1.2. This connection can be interrupted, open in only one flow direction or in both flow directions, depending on the switching mode of the control device.

The switch valve unit 2 fulfills the function of a switch valve, formed by a 2/2-way valve, and a pilot-operated check valve. In the hydraulic circuit shown in the figures, the operation of the switch valve unit 2 is therefore explained on the basis of a switch valve 2.1 and a pilot-operated check valve 2.2.

The switch valve unit 2 has a supply connection 2.3, the opening and unlocking connection 2.4, and a return connection 2.5.

The supply connection 2.3 is connected to the second consumer connection B via the second line V2. When pressure is applied to the locking chamber 1.2, the hydraulic medium is supplied to the switch valve unit 2 via this supply connection 2.3.

The supply connection 2.5 is connected to the locking chamber 1.2 via the third line V3. When the pressure in the locking chamber 1.2 is relieved, the fluid is returned via this return connection 2.5.

Via the opening and unlocking connection 2.4, pressure is applied to a hydraulic control connection 2.4.1 of the switch valve 2.1 and to an unlocking connection 2.4.2 of the check valve 2.2 when the first connection V1 and thus the unlocking cylinder 1.1 are pressurized.

It is essential to the invention that the switch valve 2.1 can be switched mechanically via the displacement of the button 4 into two switching positions in which the securing element 5 is displaced into an unlocking position and a locking position, respectively, and can be switched hydraulically only into the switching position in which the securing element 5 is pushed into the unlocking position.

Thus, the control device meets required safety conditions.

Locking can only be performed when the button 4 is in an engaged position. The button 4 protruding from the quick-change device 10 is engaged in the quick-change device 10 while the two connecting partners are paired as intended when the attachment unit 11 is coupled to the quick-change device 10, and is then fully engaged when they are adjacent to each other as intended and form a connection. Immediately after the button 4 is fully engaged, the securing element 5 is automatically pushed into the locking position.

The idea of switching a valve between an open position and a closed position by means of a mechanical button in order to allow the movement of a securing element from an open position to a closed position only when the valve is fully engaged is known from the prior art. However, there are no solutions for an alternative actuation of the valve in case there is no access to the valve because the securing element 5 is not in the unlocking position.

Figure 3A:
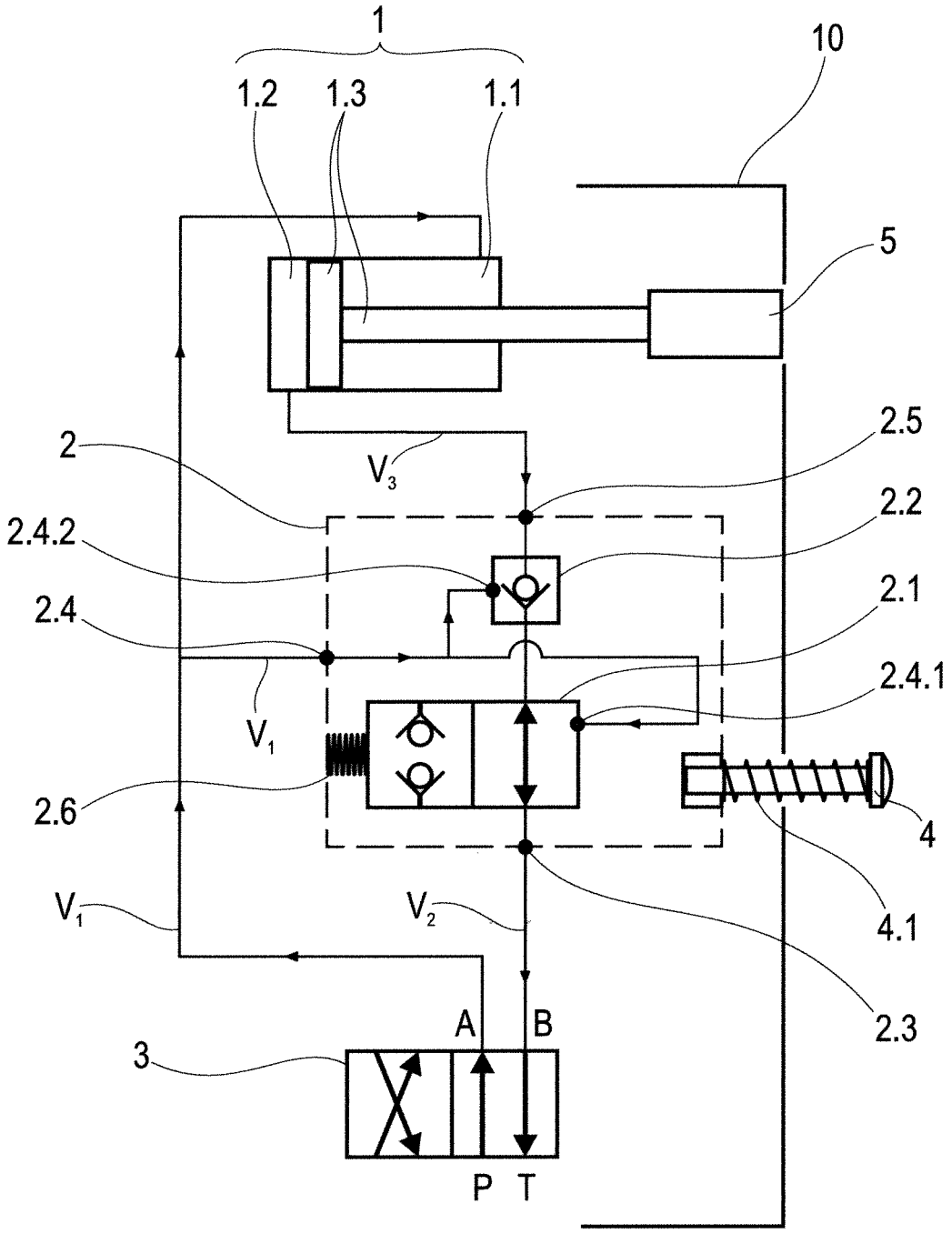
FIG. 3*a* shows a hydraulic circuit diagram of a control device of the quick-change device in a first switching mode, the securing element is in the unlocking position, the button is fully disengaged and the changeover valve is in the first switching position.

FIG. 3*a* shows the hydraulic circuit in a first switching mode. The securing element 5 is in the unlocking position and the button 4 is fully disengaged and the changeover valve 3 is in the first switching position.

The first connection V1 and the unlocking chamber 1.1 are under pressure, the piston 1.3 is retracted and the locking element 5 is in the unlocking position. Due to the pressure present at the opening and unlocking connection 2.4, the check valve 2.2 is unlocked and the switch valve 2.1 is in an open position so that the fluid can be discharged via the tank connection T to relieve the pressure in the locking chamber 1.2. The button 4 is in the fully disengaged position, held by the return force of the button return spring 4.1.

Figure 3B:
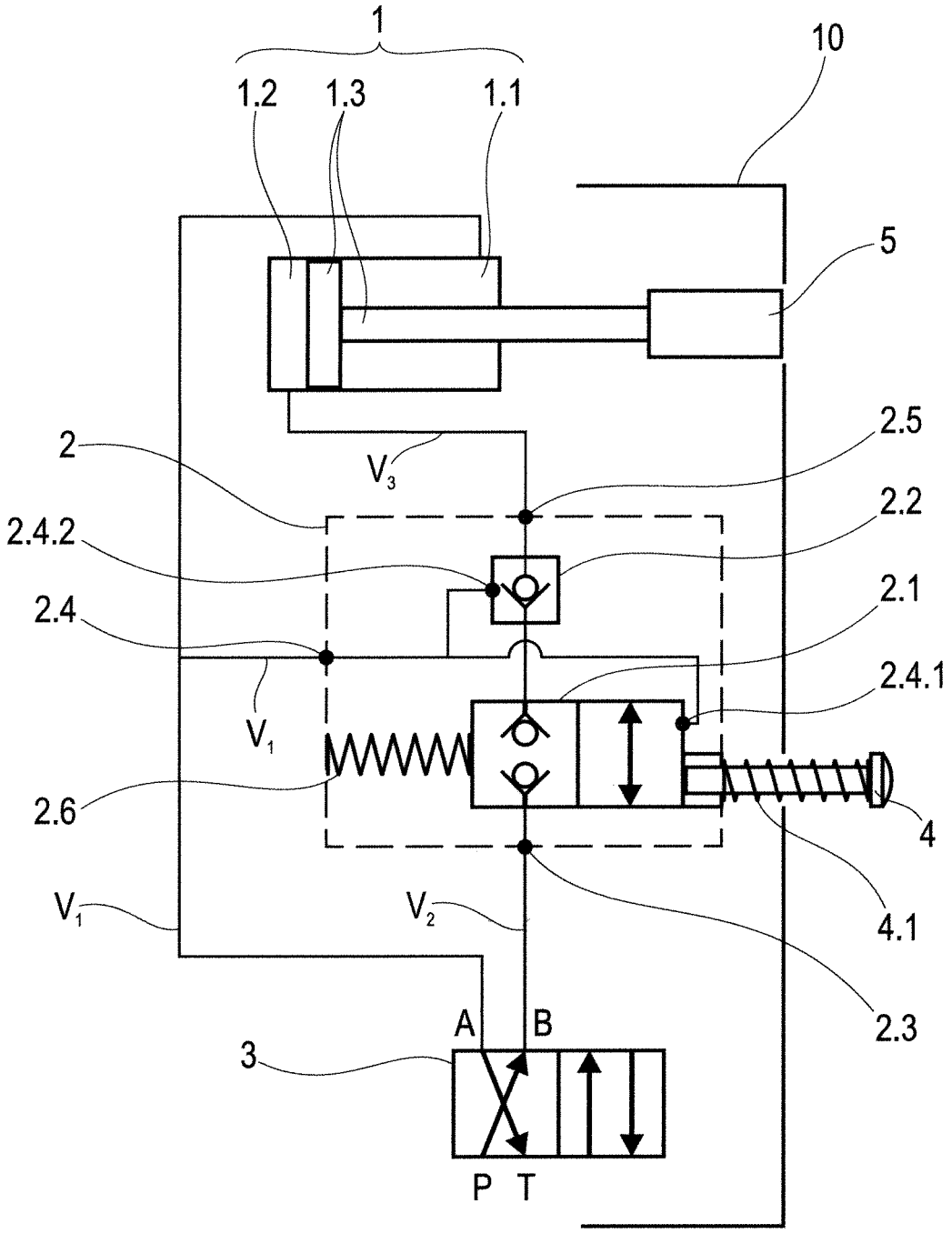
FIG. 3*b* shows the hydraulic circuit diagram according to FIG. 3*a* in a second switching mode, after the changeover valve has only been switched in the first switching mode.

FIG. 3*b* shows the hydraulic circuit in a second switching mode. The changeover valve 3 was unintentionally switched to the second switching position. This depressurizes the first line V1, the switch valve 2.1 changes to a closed position, and the check valve 2.2 is closed. The piston 1.3 remains in the unlocking position due to the closed, hermetically sealed space formed by the locking chamber 1.2 closed by the check valve 2.2. This ensures that locking cannot take place if an attachment unit is not yet correctly coupled to the work machine 12. Basically, regardless of the position of the changeover valve 3, the securing element 5 remains in the unlocking position when the button 4 is in a disengaged position or the fully disengaged position. However, if the work machine 12 is not in use for a prolonged period of time, leakage will cause a pressure drop in the hydraulic circuit and the piston 1.3 may be displaced, unintentionally disengaging the securing element 5 in the direction of the locking position.

To lock, it is imperative that the button 4 is pushed to a fully engaged position. This is only possible mechanically by actuating the button 4 when the securing element 5 is also in the unlocking position. It is essential to the invention that the hydraulic circuit is designed so that the securing element 5, through the possibility of alternative hydraulic switching of the switch valve unit 2, can also be unlocked when there is no access to the button 4.

Preferably, the changeover valve 3 is in its second switching position when the button 4 is to be engaged for locking.

Figure 3C:
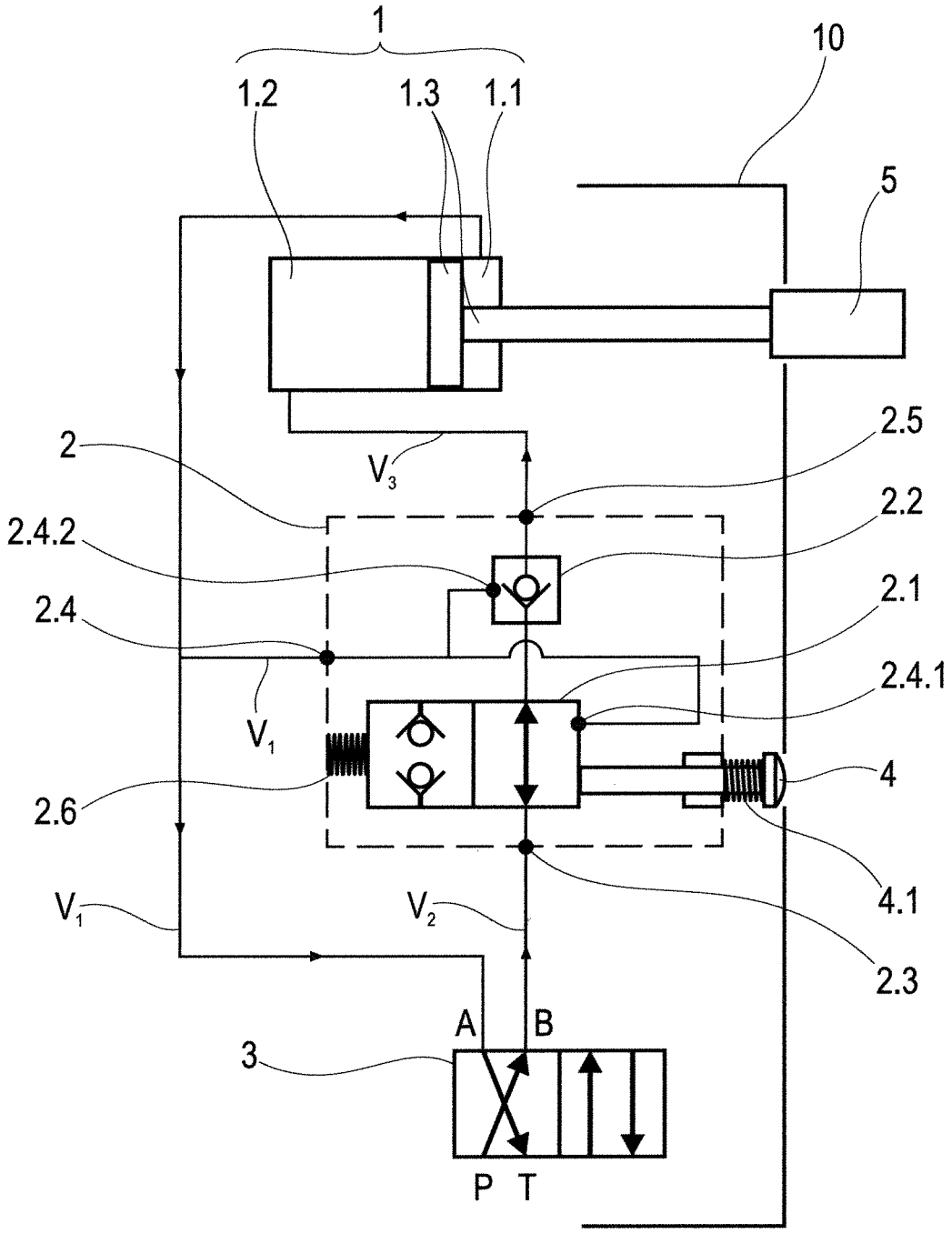
FIG. 3*c* shows the hydraulic circuit diagram according to FIG. 3*a* in a third switching mode, after the button has been engaged in the second switching mode.

The hydraulic circuit is shifted from the second switching mode (FIG. 3*b*) to a third switching mode, shown in FIG. 3*c*, by mechanically engaging the button 4. This is done while coupling the attachment unit 11 to the quick-change device 10 of the work machine 12. When the button 4 is fully engaged, the switch valve 2.1 is mechanically switched to the open position. The fluid present at the supply connection 2.1 of the switch valve unit 2 is directed under pressure via the check valve 2.2 in its flow direction into the locking chamber 1.2, and the fluid present in the unlocking chamber 1.1 flows back into the tank. The piston 1.3 is extended and the securing element 5 is guided into the locking position.

Figure 3D:
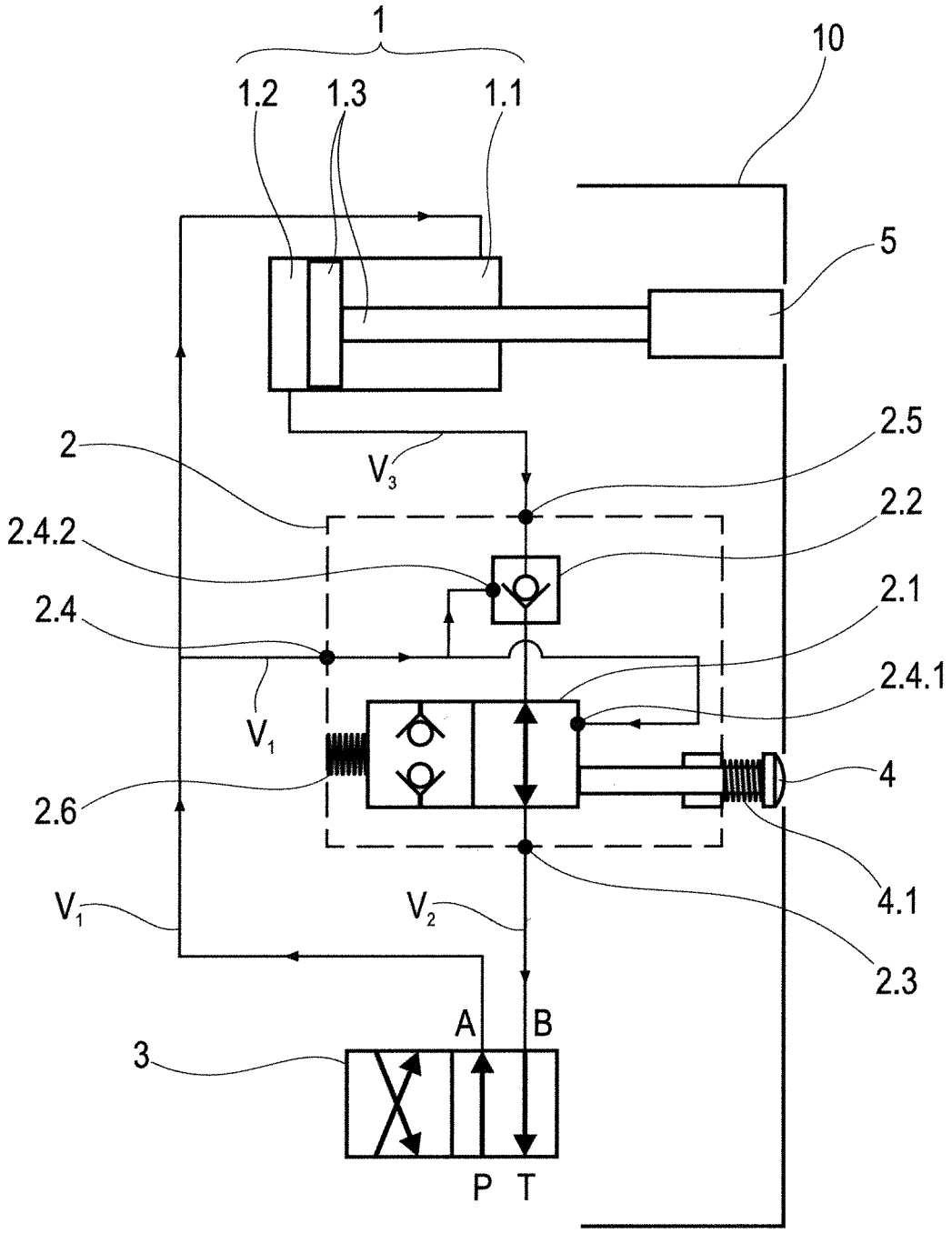
FIG. 3*d* shows the hydraulic circuit diagram according to FIG. 3*a* in a fourth switching mode, after the button has been engaged in the second switching mode.

The hydraulic circuit can also be in the first switching mode (FIG. 3*a*) when the button 4 is mechanically engaged, as shown in FIG. 3*d*. The changeover valve 3 is in the first switching position here, with a hydraulic pressure being applied to the first line V1 and thus to the switch valve 2.1, so that the latter is switched to the open position regardless of the position of the button 4, on its way between the fully disengaged position and the fully engaged position. If the changeover valve 3 is switched to the second switching position after the button has been fully engaged, it remains in the open position even though the control pressure drops, and the locking chamber 1.2 is pressurized so that the securing element 5 is guided into the locking position.

It is not decisive in which of the two positions the changeover valve 3 is when the mechanical button 4 is actuated. In the first position of the changeover valve 3, automatic locking takes place immediately, while in the second position it is still necessary to actively switch to the first position before locking takes place.

If it is not possible to actuate the mechanical button 4 during coupling because the path for this is blocked by the unintentionally disengaged securing element 5, the first switching position of the changeover valve 3 is switched to or the hydraulic pump connected to the pressure connection P is switched on in this switching position, whereby the securing element 5 is pushed back into the unlocking position in a hydraulically controlled manner.

LIST OF REFERENCE NUMERALS

1 hydraulic cylinder
- 1.1 unlocking chamber
- 1.2 locking chamber
- 1.3 piston

2 switch valve unit with check function
- 2.1 switch valve (with open position and closed position)
- 2.2 check valve
- 2.3 supply connection
- 2.4 opening and unlocking connection
  - 2.4.1 hydraulic control connection
  - 2.4.2 unlocking connection
- 2.5 return connection
- 2.6 valve return spring

3 changeover valve

4 button
- 4.1 button return spring

5 securing element

10 quick-change device

11 attachment unit

12 work machine

V1 first line, between a first consumer connection A, on the one hand, and the unlocking chamber 1.1 and the opening and unlocking connection 2.4 on the other hand V2 second line, between the second consumer connection B, on the one hand, and the supply connection 2.3 on the other hand V3 third line, between the locking chamber 1.2, on the one hand, and the return connection 2.5 on the other hand A first consumer connection B second consumer connection P pressure medium connection T tank connection

The invention claimed is:

1. A quick-change device for coupling an attachment unit to a work machine, comprising:

a securing element which is pushed into a locking or unlocking position to lock or secure and unlock or release, respectively, the coupled attachment unit, and a control device, with a hydraulic cylinder comprising an unlocking chamber and a locking chamber, a changeover valve with a first consumer connection, a second consumer connection, a pressure medium connection and a tank connection, a first line between the first consumer connection and the unlocking chamber, a switch valve, which is controllable hydraulically via a hydraulic control connection and mechanically via a spring-loaded button, which is pushed into a fully engaged position during proper coupling and into a fully disengaged position during uncoupling, wherein:

the switch valve is arranged between the second consumer connection and the locking chamber and is configurable to be switched between an open position and a closed position and is switched to the open position when the button is fully engaged, so that the securing element, controlled via the changeover valve, is pushed into the locking or unlocking position, and the hydraulic control connection is connected to the first line, whereby the switch valve is switched to the open position by applying hydraulic pressure from the first line even when the button is disengaged or not fully engaged, which pushes the securing element to the unlocking position regardless of the position of the button.

2. The quick-change device according to claim 1 wherein the switch valve has a valve return spring with a spring force that switches the switch valve to the closed position when no hydraulic and/or mechanical pressure is applied.

3. The quick-change device according to claim 2, wherein the button is assigned a button return spring connected in series with the valve return spring.

4. The quick-change device according to claim 3, wherein a pilot-operated check valve is arranged upstream of the locking chamber, with a hydraulic unlocking connection connected to the first line.

5. The quick-change device according to claim 4, wherein the switch valve and the check valve are integral components of a switch valve unit.

* * * * *